US005660764A

United States Patent [19]

Lu

[11] Patent Number: 5,660,764

[45] Date of Patent: Aug. 26, 1997

[54] CARBURETION DEVICE FOR AUTOMOBILE ENGINES

[76] Inventor: Teng-Hui Lu, No. 29, Nei Keng, Nei Keng Tsun, Ta Liao Hsiang, Kaohsiung Hsien, Taiwan

[21] Appl. No.: 655,265

[22] Filed: Jun. 4, 1996

[51] Int. Cl.[6] ..... F02M 27/04

[52] U.S. Cl. ..... 261/1; 123/537; 123/538

[58] Field of Search ..... 123/537, 538; 261/DIG. 80, 1

[56] References Cited

U.S. PATENT DOCUMENTS

| | | | |
|---|---|---|---|
| Re. 35,181 | 3/1996 | Hudz | 261/DIG. 80 |
| 4,460,516 | 7/1984 | Kapitanov et al. | 261/DIG. 80 |
| 5,059,743 | 10/1991 | Sakuma | 261/DIG. 80 |
| 5,331,807 | 7/1994 | Hricak | 123/538 |

*Primary Examiner*—Tim R. Miles
*Attorney, Agent, or Firm*—Pro-Techtor International

[57] ABSTRACT

The present invention relates to a carburetion device for automobile engines, which comprises a magnetite-containing carburetor 1. One side of the magnetite-containing carburetor 1 is connected to an engine and the other side is connected to a fuel hose 2, and a layer of magnetite is coated on the fuel hose 2 near the magnetite-containing carburetor 1. With this novel practical design, the fuel is magnetized, thereby allowing the fuel to be combusted at an efficiency of at least 98%, thus improving the air quality, prolonging the working life of automobile engines, and lowering the failure frequency of automobile parts.

2 Claims, 2 Drawing Sheets

CARBURETION DEVICE FOR AUTOMOBILE ENGINES

(A) BACKGROUND OF THE INVENTION

The present invention concerns an improved carburetion device for automobile engines. More specifically, the invention relies on the effect of magnetite emitting infrared radiation when heated, and its characteristics, which include infrared irradiation, penetrability and resonance absorption, are applied in carburetors for automobile engines, thereby enhancing the performance of the carburetors.

Conventional carburetion devices for automobile engines, involving connecting an assembled carburetor with a fuel hose, do not possess the function of magnetizing the fuel. Consequently, the fuel cannot be adequately combusted, which leads to problems, such as causing air pollution, reducing the working life of automobile engines, and increasing the failure frequency of automobile parts.

The following advantages can be obtained with the carburetion device of the present invention for automobile engines:

(1) The present device causes the fuel to be magnetized, thereby allowing the fuel to be combusted at an efficiency of at least 98%, which reduces the carbon monoxide content and significantly improves the air quality.

(2) The present device can prolong the working life of automobile engines and lower the failure frequency of automobile parts.

(B) BRIEF DESCRIPTION OF THE DRAWINGS

Figure 1:
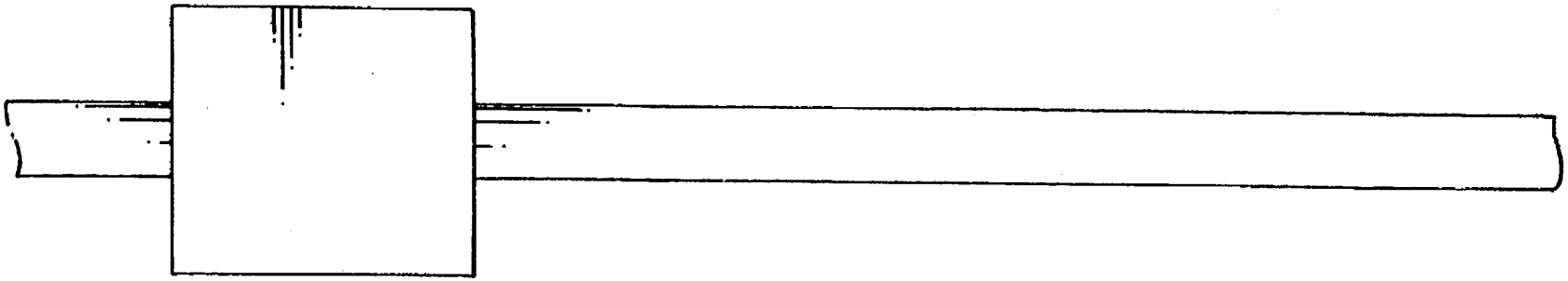

FIG. 1: A configuration applied in conventional products.

Figure 2:
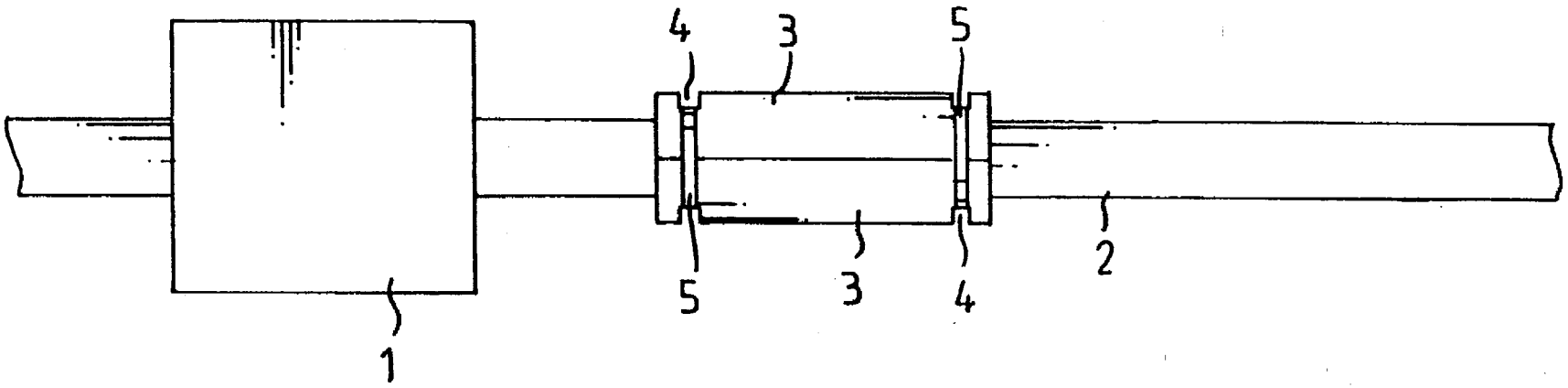

FIG. 2: A configuration applied in the present novel device.

(C) DESCRIPTION OF THE PREFERRED EMBODIMENTS

As shown in FIG. 2, the carburetion device of the present invention comprises a magnetite-containing carburetor 1, which is fabricated by adding an appropriate amount of magnetite during the carburetor manufacturing process and then subjecting the carburetor unit to sintering. One side of the magnetite-containing carburetor 1 is connected to an engine, and the other side is connected to a fuel hose 2. Two half-rounded plastic sleeves 3 are installed on the fuel hose 2 near the magnetite-containing carburetor 1. The chamber formed by the two half-rounded plastic sleeves 3 is packed with magnetite that comes into contact with the fuel hose 2. The two half-rounded plastic sleeves 3 are fastened to each other by means of inserting a tie 5 around each of the two round grooves 4 formed at the two ends when the two half-rounded plastic sleeves 3 are joined together. When the engine is started, the fuel flows into the magnetite-containing carburetor 1 via the fuel hose 2. Since both the two half-rounded plastic sleeves 3 and the magnetite-containing carburetor 1 contain magnetite, the fuel is magnetized, thereby allowing the fuel to be combusted at an efficiency of at least 98%, which reduces the carbon monoxide emission, significantly improves the air quality, prolongs the working life of automobile engines, and lowers the frequency of failure of automobile parts.

I claim:

1. A carburetion device for automobile engines, characterized in that the carburetion device comprises a magnetite-containing carburetor 1, which is fabricated by adding an appropriate amount of magnetite during the carburetor manufacturing process and then subjecting the carburetor unit to sintering, in that one side of the magnetite-containing carburetor 1 is connected to an engine and the other side is connected to a fuel hose 2, and in that a layer of magnetite is laid onto the fuel hose 2 near the magnetite-containing carburetor 1.

2. The carburetion device for automobile engines according to claim 1, characterized in that two half-rounded plastic sleeves 3 are installed on the fuel hose 2 near the magnetite-containing carburetor 1, in that the chamber formed by the two half-rounded plastic sleeves 3 is packed with magnetite that comes into contact with the fuel hose 2, and in that the two half-rounded plastic sleeves 3 are fastened to each other by means of inserting a tie 5 around each of the two round grooves 4 formed at the two ends when the two half-rounded plastic sleeves 3 are joined together.

* * * * *